United States Patent [19]

Diaz

[11] Patent Number: 4,476,883

[45] Date of Patent: Oct. 16, 1984

[54] CONTAINER ASSEMBLY

[76] Inventor: Daniel Diaz, 5376 W. 14th La., Hialeah, Fla. 33012

[21] Appl. No.: 532,550

[22] Filed: Sep. 15, 1983

[51] Int. Cl.[3] ..... A45D 29/00

[52] U.S. Cl. ..... 132/73; 206/210

[58] Field of Search ..... 132/73; 206/210, 581; 215/200

[56] References Cited

U.S. PATENT DOCUMENTS

| | | | |
|---|---|---|---|
| D. 118,830 | 2/1940 | Newman | 132/73 UX |
| 2,424,509 | 7/1947 | Singer | 132/73 U X |
| 3,060,942 | 10/1962 | Finlay | 132/73.5 |
| 3,807,954 | 4/1974 | McDonald | 206/210 |
| 4,249,551 | 2/1981 | Nordstrom | 132/73 |
| 4,282,891 | 8/1981 | Duceppe | 132/73.5 |

FOREIGN PATENT DOCUMENTS

| | | | |
|---|---|---|---|
| 49759 | 9/1981 | Fed. Rep. of Germany | 132/73 |

*Primary Examiner*—Gregory E. McNeill

*Attorney, Agent, or Firm*—John Cyril Malloy

[57] ABSTRACT

A container assembly of the type specifically structured for applying a predetermined liquid or solution to the fingernails of a person. A sponge material is disposed on the interior of a housing and preferably corresponds to the configuration thereof. A plurality of recesses being dimensioned and configured to receive the fingertip and accordingly the fingernail of the user are formed on the exposed surface of the sponge material in a predetermined array facilitating placement of all the fingers in various recesses. A liquid or solution such as nail biting preventative or nail strengthener is applied to the interior of the housing and the sponge material wherein the housing is filled to a level sufficient to form small pools in the bottom of each of the recesses.

9 Claims, 4 Drawing Figures

CONTAINER ASSEMBLY

BACKGROUND OF THE INVENTION

1. Field of the Invention

A container assembly including a housing of predetermined configuration having a sponge or like material in the interior thereof which is specifically structured to apply a predetermined solution to the fingernail of a user when the fingertips are positioned on the exposed surface of the sponge material.

2. Description of the Prior Art

Applying solution to a person's fingernail for the purpose of strengthening the nail or for the purpose of preventing nail biting has been known for many years. Generally, these solutions have been applied in a manner similar to fingernail polish wherein the liquid solution is merely rubbed on. Such manual methods are effective only to a point and primarily serve to apply the predetermined solution to the front of the nails rather than underneath the nails or down to the junction where the nail extends from the fingertip.

Accordingly, there is a need for a container assembly structured to serve as an applicator for any given liquid to be applied to the fingernail in a manner which will completely submerge the front portion and underneath surface of the nail into the predetermined liquid.

The prior art recognizes numerous structures which include a cup or some type of container enclosing a sponge material structure saturated with water or other liquid. Such devices are primarily designed to moisten the fingers to facilitate turning pages or the like or otherwise to moisten stamps or adhesive surfaces. Such devices are represented in the following U.S. Pat, Nos. to Weaver, 1,540,379; Harris, 1,735,046; Sengbusch, 2,658,474; Carroll, 2,841,811; and Borah, 2,932,277.

While the above references disclose structure for moistening or cleaning the fingers, none of the above cited patents disclose the concept of applying a predetermined liquid to the nails rather than the fingers themselves.

SUMMARY OF THE INVENTION

The present invention is directed towards a container assembly comprising a housing means having a predetermined substantially U-shaped configuration. The boundary of the housing means and the interior thereof is defined by a continuous cylindrical wall having a curvilinear configuration along its length wherein the interior of the housing is also defined by a substantially U-shaped configuration.

An inset portion is disposed in substantially centered relation between the spaced apart ends of the U-shaped housing means, A base having a substantially planar configuration extends along the bottom of the housing means and further extends outwardly therefrom to cover a bottom end of the inset portion.

The container assembly further includes a cover means including a lid which has an upper planar configuration wherein the lid is configured to cover and close an open end of the housing means which communicates with the interior thereof. Further, the planar portion of the lid extends outwardly to overhang the inset portion. Removal of the lid from its closed position over the open end of the housing means is readily accomplished by providing force such as fingertips on the undersurface of the lid which overhangs the inset portion. This lifting force will easily remove the cover means or lid from the housing means when application is desired.

A sponge material means is disposed on the interior of the housing means and generally conforms or corresponds to the U-shaped configuration of the interior. Further, the sponge material means substantially fills the interior to a level which is spaced from the open end of the housing means. The exposed surface of the sponge material means is thereby readily accessible for any user of the subject container assembly.

An important feature of the present invention comprises the provision of a plurality of recesses integrally formed on the exposed surface of the sponge material means. Each of the recesses has a substantially concave configuration extending downwardly from the exposed surface. A certain number of the plurality of recesses are dimensioned and configured to receive the tip of the thumb for the purpose of applying the predetermined liquid to the thumb nail. Other ones of the plurality of recesses are dimensioned somewhat smaller by having the same basic configuration. These smaller recesses are provided to receive the fingertip of the other fingers of the hand and thereby apply the liquid to the associated fingernails.

It should be noted that the sponge material means in the preferred embodiment is made from a sponge-like material. However, it should be noted that other material may be utilized which is basically structured to absorb and hold liquid therein and be sufficiently flexible so as to be depressible when force is applied to any of the recesses by a fingertip.

In use, one merely places his fingertips and nails within the appropriately dimensioned recesses and depresses the surface somewhat until the nail portion is submerged or substantially totally surrounded by the sponge material means itself. The liquid, retained within the sponge material means, is thereby applied to all portions of the fingernail including the undersurface thereof.

BRIEF DESCRIPTION OF THE DRAWINGS

For a fuller understanding of the nature of the present invention, reference is made to the following detailed drawings, in which.

Similar reference characters refer to similar parts throughout the several views of the drawings.

DETAILED DESCRIPTION OF THE PREFERRED EMBODIMENT

The present invention is directed towards a container assembly generally indicated as 10 designed for the application of a predetermined liquid such as nail strengthener or nail biting preventative, to the fingernails of a person. The container assembly 10 comprises a housing means generally indicated as 30 and having a substantially continuous cylindrical housing wall 32 defining the boundaries of the housing means. The housing means is shaped into a substantially U-shaped configuration with an inset portion 39 disposed in substantially centered relation between the protruding ends of the housing means 30.

Figure 2:
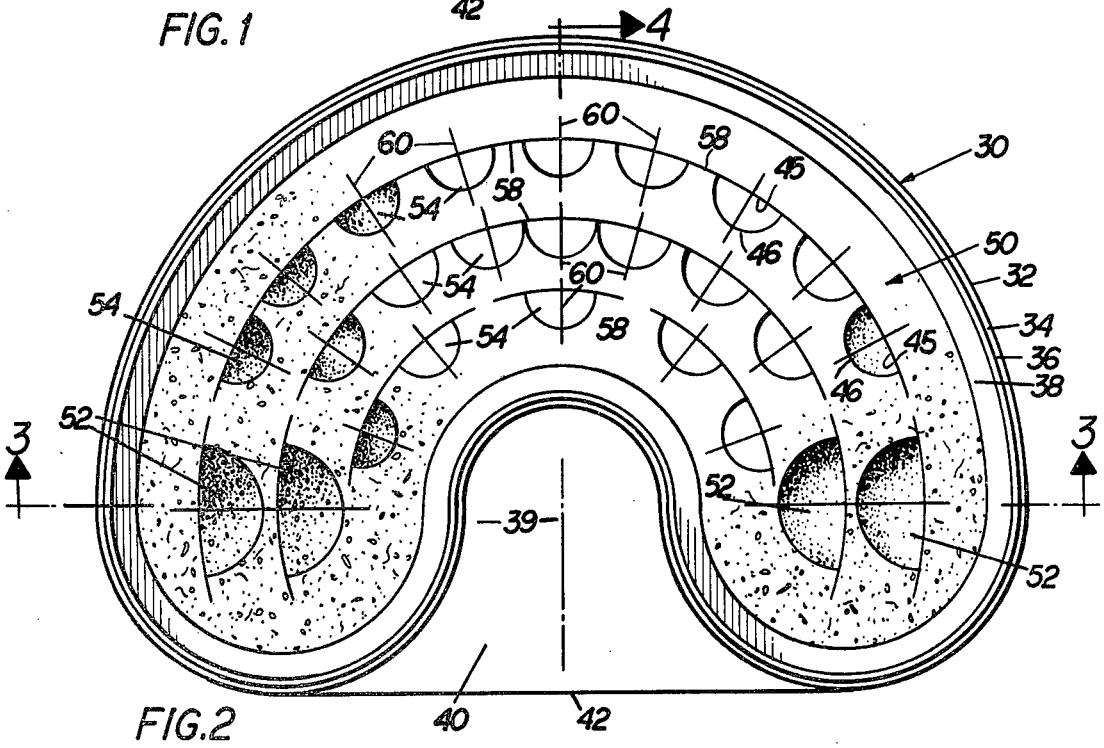
FIG. 2 is a top plan view of the embodiment of FIG. 1 showing the interior of the housing means and the plurality of recesses formed on a sponge material disposed within the housing.

The housing means comprises a base 23 having a substantially planar configuration and extending entirely across the bottom of the housing means 30. Further, the base extends beyond the inset protion 39 so as to substantially close off the bottom thereof as at 40. The outwardly protruding edge 42 is disposed in substantially aligned relation with the protruding ends of the housing means as best shown in FIG. 2.

The container assembly of the present invention further comprises a cover means generally indicated as 20 which is defined by a lid element 22 having a planar surface configured to extend over the entire housing means including the inset base portion 40 and enclose or cover the open end 33 of the housing interior. A seal is defined through the cooperative disposition of a depending flange 24 integrally formed on and extending from the undersurface of the lid 22. This depending flange 24 substantially conforms in configuration to the open end 33 of the housing means and more particularly to the upstanding flange 36 defining the periphery of the interior of the housing means. As clearly shown in FIGS. 3 and 4, the depending flange 24 is disposed in overlapping, side-by-side and substantially surrounding relation to the upstanding flange 36 thereby preventing spillage of any liquid maintained on the interior of the housing 30.

Figure 3:
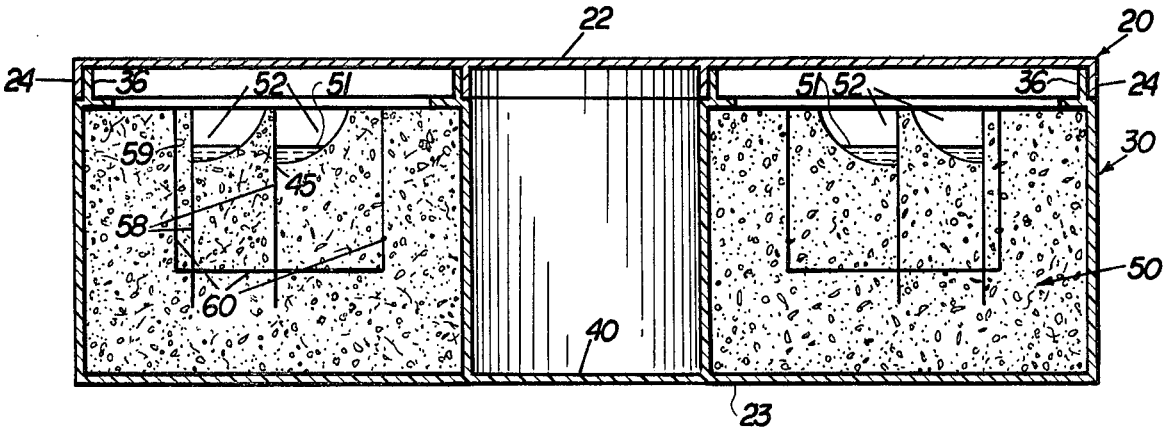
FIG. 3 is a sectional view taken along line 3—3 of FIG. 2.
Figure 4:
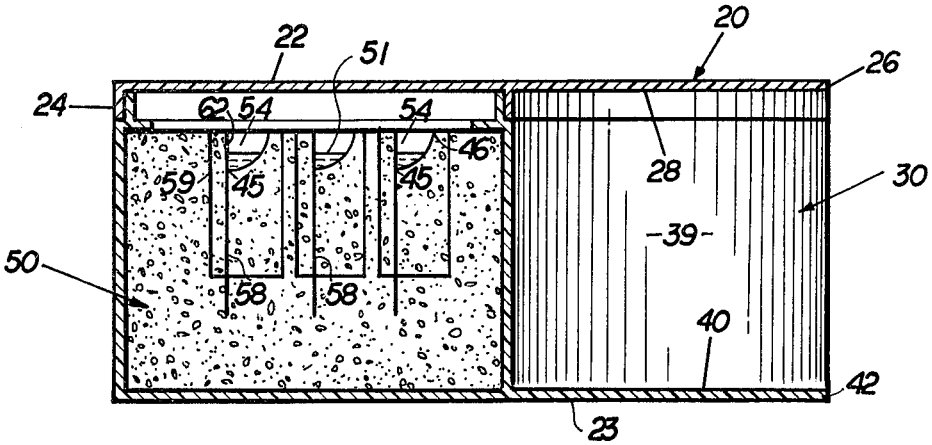
FIG. 4 is a sectional view taken along line 4—4 of FIG. 2.

With reference to FIG. 4, the lid 22 is removed from its closed position as show in FIGS. 3 and 4 merely by placing the fingers within the inset portion 39 and providing a lifting force to the undersurface 28 of the lid 22 which overhangs the inset portion 39. As further shown in FIG. 4, the outer peripheral edge 26 of the lid element 22 is disposed in substantially aligned relation to the outwardly extending peripheral edge 42 of base 23.

Figure 1:
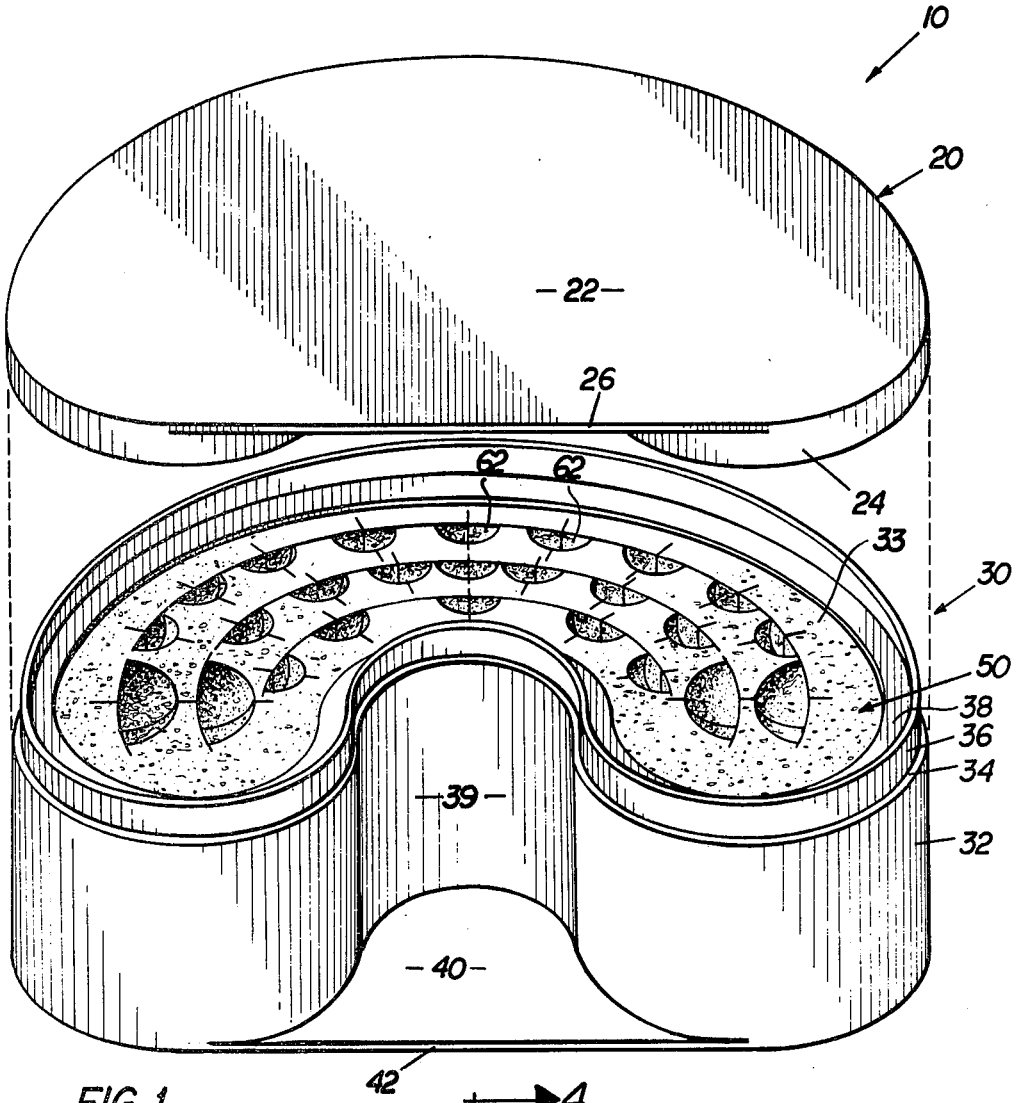
FIG. 1 is an isometric view of the container assembly of the present invention with the lid portion removed therefrom.

Further structural features of the present invention comprise the provision of a sponge material means 50 serving as a filler on the interior of the housing means 30. It can be seen that the sponge material means 50 conforms to the U-shaped configuration of the interior of the housing means 30. Further, the sponge material means is dimensioned to substantially fill the interior of the housing means and be retained beneath peripheral flange 38. As best shown in FIGS. 1 and 3, the peripheral flange 38 is disposed about the periphery of the interior and extends inwardly towards the center thereof. Further, the flange 38 is disposed in overlapping relation to the outer and upper peripheral edge of the sponge material means 50 (FIG. 3).

An important feature of the present invention comprises the provision of a plurality of recesses integrally formed in the exposed surface of the sponge materia means 50. More particularly, the recesses each have a substantially concave configuration extending from the frontmost edge 45 located below the exposed surface (see FIGS. 3 and 4) to the rearmost curvilinear edge 46 disposed substantially coplanar with the exposed surface of the sponge material means 50.

As best shown in FIGS. 1 and 2, the plurality of recesses are arranged in a number of rows wherein the alignment of the rows is substantially semi-circular. Further, recesses 52 are correspondingly configured to the remainder of the recesses but are somewhat larger. These recesses are particularly dimensioned and configured to receive the tip of a thumb therein such that the fingernail can be substantially embedded and/or surrounded by the sponge material means for total application.

The remaining recesses 54, as stated above, are correspondingly configured to the larger recesses 52 but are structured to have a smaller dimension so as to adequately receive, in substantially close surrounding relation, the remaining four fingers of the hand.

Other structural features of the recesses include the provision of a first cut 58 (see FIGS. 3 and 4) extending from the exposed surface of the sponge material means 50 downwardly to a point beyond the depth of the associated recess. A junction is formed between the wall portion 59 and more specifically the exposed surface 62 defined by the downward first cut 58, and the leading edge 45 of the recess. Therefore, the junction is separable in that a depression of the finger mainted within the recess will plunge between the exposed surface 62 and the front edge 45 to obtain total contact with the surrounding sponge material means 50.

With reference to FIGS. 1, 2 and 3, each of the plurality of recesses further includes a second cut 60 extending from the exposed surface of the sponge material means 50 downwardly to a point beyond the depth of each of the recesses. Further, these second cuts 60 substantially disect into the recesses and passes through the middle thereof. As shown in FIG. 2, each of the second cuts 60 extend beyond both the front and rear portions of each recess so as to separate the recesses into separable portions.

The provision of these cuts allows a deeper penetration of the tip of the finger when pressure is applied thereby to the recesses which in turn provides a total application and contact of the liquid to the fingernail being treated.

The liquid desired to be applied to the fingers is placed on the interior of the housing means 30 and permeates the sponge material means 50. The amount of liquid should be such as to provide small pools 51 in each of the recesses as clearly shown in FIGS. 3 and 4.

Further, it is seen with reference to FIG. 2, that the first cuts 58 of a predetermined number of recesses may be disposed in aligned relation such that the adjacent recesses form a plurality of rows each having a curvilinear configuration.

In use, a person merely takes the tip of his fingers and presses them into the recesses such that the nail is readily exposed to the surrounding sponge material means 50. Further force being applied by the fingertips serves to further submerge the fingertip and accordingly the entire nail including its undersurface which is brought into direct contact with the liquid to be applied.

What is claimed is:

1. A container assembly of the type designed for the application of a predetermined liquid to a person's fingernails, said container assembly comprising:

housing means including a base and an open end disposed opposite to said base, cover means dimensioned and configured to cover said open end, said housing means defining an interior of predetermined configuration; sponge material means disposed within said housing interior and substantially conforming to said housing interior configuration, a plurality of recesses integrally formed in an exposed surface of said sponge material means, each of said recesses comprising a depressed surface disposed below said exposed surface of said sponge material means and configured to receive a fingertip therein; said recesses include a first cut extending from said exposed surface of said sponge material means down into the interior thereof to a depth greater than that of said recesses and further disposed to define a frontmost boundary of said respective recesses; said first cut defining a wall portion disposed in abutting relation to a front edge of said recesses and in separable relation thereto, a separable junction formed between said wall portion and said front edge of said recesses; said recesses being structured to pass a fingernail through said junction between said wall portion and said front edge, wherein each of said recesses comprises a substantially concave configuration extending from said front edge of each of said recesses, disposed beneath the exposed surface of said sponge material means, to a rearmost edge disposed coplanar with said disposed surface of said sponge material means, whereby liquid to be applied is disposed within said housing interior and said sponge material means and filled to a level substantially equal to the bottom of said recess.

2. A container assembly as in claim 1 wherein said plurality of recesses are of varied dimension and include at least one recess having a larger dimension than the other of said recesses and substantially configured to receive a tip of a person's thumb therein

3. A container assembly as in claim 2 wherein a number of said plurality of recesses having a dimension less than said one recess and being dimensioned and configured to receive tips of fingers other than the thumb.

4. A container assembly as in claim 1 wherein said recesses further comprise a second cut disposed in transverse relation to said first cut and disposed in bisecting relation to said recesses and extending beyond the front and rear of said recesses.

5. A container assembly as in claim 4 wherein said plurality of recesses are arranged in at least one row having a substantially semi-circular configuration, wherein said second cuts are disposed in aligned relation to one another along said semi-circular configuration.

6. A container assembly as in claim 5 wherein said recesses are collectively arranged in a plurality of rows each disposed in spaced apart relation to one another and each comprising a substantially curvilinear configuration.

7. A container assembly as in claim 1 wherein said housing means comprises a continuous cylindrical housing wall defining the boundary of said housing interior, said housing means and said housing interior including a substantially U-shaped configuration, said cover means configured to close said open end thereof.

8. A container assembly as in claim 7 wherein said housing means further includes an inset portion disposed in the substantial center of said U-shaped configuration, said base extending beneath said inset portion and closing the bottom end thereof.

9. A container assembly of the type designed for the application of a predetermined liquid to a person's fingernails, said container assembly comprising:

housing means including a base and an open end disposed opposite to said base, cover means dimensioned and configured to cover said open end, said housing means defining an interior of predetermined configuration; sponge material means disposed within said housing interior and substantially conforming to said housing interior configuration, a plurality of recesses integrally formed in an exposed surface of said sponge material means, each of said recesses comprising a depressed surface disposed below said exposed surface of said sponge material means and configured to receive a fingertip therein; said housing wall comprising a substantially continuous, curvilinear upper peripheral edge further configured into a substantially U-shaped configuration corresponding to a substantially U-shaped configuration of said housing means and a remainder of said housing wall, said cover means structured for mating engagement with said curvilinear upper peripheral edge and further dimensioned and configured for substantially overhanging relation to an open end on inset portion disposed in the substantial center of said U-shaped configuration of said housing means and in spaced relation to said base closing said bottom end of said inset portion, said cover means comprising a top planar portion configured and dimensioned to extend over said open ends of both said housing means and said inset portion, said planar portion structured and disposed for the removal of said cover means from said housing means upon the application of pressure to the undersurface of said planar portion of said cover means overhanging said inset portion, said cover means further comprising a depending flange extending from said undersurface of said planar portion; said housing means comprising an upstanding flange defining an upper peripheral edge and disposed in surrounding relation to said open end of said housing means, said depending flange correspondingly configured to said upstanding flange and dimensioned and disposed in overlapping and surrounding relation to said upstanding flange and in sealing relation to said open end of said housing means.

* * * * *